US007055946B2

(12) United States Patent
Bejat et al.

(10) Patent No.: US 7,055,946 B2
(45) Date of Patent: Jun. 6, 2006

(54) APPARATUS AND METHOD FOR PRINTING WITH AN INKJET DRUM

(75) Inventors: Ligia A. Bejat, Versailles, KY (US); Gerald L Fish, Versailles, KY (US); Michael C. Leemhuis, Nicholasville, KY (US); Claudia A. Marin, Lexington, KY (US); Jean Marie Massie, Lexington, KY (US); Calvin D. Murphy, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/459,928

(22) Filed: Jun. 12, 2003

(65) Prior Publication Data

US 2004/0252175 A1 Dec. 16, 2004

(51) Int. Cl.
*B41J 2/01* (2006.01)

(52) U.S. Cl. ..... 347/103; 427/58

(58) Field of Classification Search ..... 347/103; 427/28; 101/375, 401.1

See application file for complete search history.

(56) References Cited

U.S. PATENT DOCUMENTS

| | | | | |
|---|---|---|---|---|
| 3,854,975 | A | 12/1974 | Brenneman et al. | |
| 3,931,793 | A | 1/1976 | Kolibas | |
| 3,990,391 | A | 11/1976 | Singh | |
| 4,192,229 | A | 3/1980 | Tsunoi et al. | |
| 4,356,764 | A | 11/1982 | Haugen | |
| 4,515,459 | A | 5/1985 | Moser et al. | |
| 4,566,778 | A | 1/1986 | Sasaki | |
| 4,727,392 | A | 2/1988 | Stone et al. | |
| 4,768,434 | A | 9/1988 | Beery | |
| 4,894,687 | A | 1/1990 | Beudet | |
| 5,092,235 | A | 3/1992 | Rise | |
| 5,319,430 | A | 6/1994 | DeBolt et al. | |
| 5,389,958 | A | 2/1995 | Bui et al. | |
| 5,671,474 | A | 9/1997 | Fukano | |
| 5,677,719 | A | 10/1997 | Granzow | |
| 5,732,319 | A | 3/1998 | Komuro et al. | |
| 5,805,191 | A | 9/1998 | Jones et al. | |
| 5,983,058 | A | 11/1999 | Yamasaki et al. | |
| 6,115,573 | A | 9/2000 | Izumi et al. | |
| 6,183,079 | B1 | 2/2001 | Meade et al. | |
| 6,196,674 | B1 | 3/2001 | Takemoto | |
| 6,506,438 | B1 * | 1/2003 | Duthaler et al. | 427/58 |

* cited by examiner

*Primary Examiner*—Stephen Meier
*Assistant Examiner*—Ly T. Tran
(74) *Attorney, Agent, or Firm*—Franics Law Office

(57) ABSTRACT

An apparatus and method for ink-jet printing including an intermediate transfer medium, a transfer medium, and an ink-jet print head to jet ink toward the intermediate transfer medium, to transfer an ink image from the intermediate transfer medium to media with an optimum image transfer and optical density. The optimum image transfer and optical density is accomplished by generating uniform pressure across a nip generated by the intermediate transfer medium and the transfer medium, and control of a release coating thickness resident on the intermediate transfer medium and a time delay between a jetting of ink toward the intermediate transfer medium and transfer of jetted ink resident on a surface of the intermediate transfer medium to the media.

19 Claims, 9 Drawing Sheets

FIG. 5A
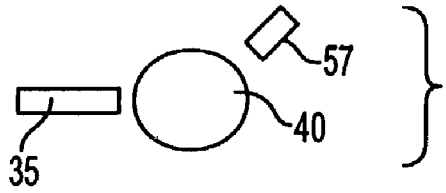
FIG. 5B
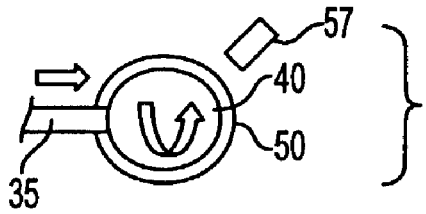
FIG. 5C
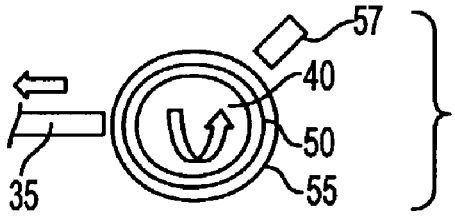
FIG. 5D
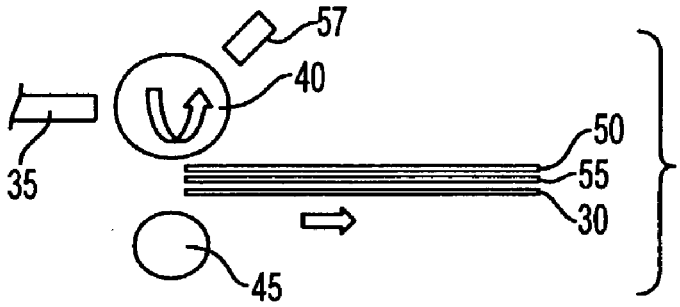
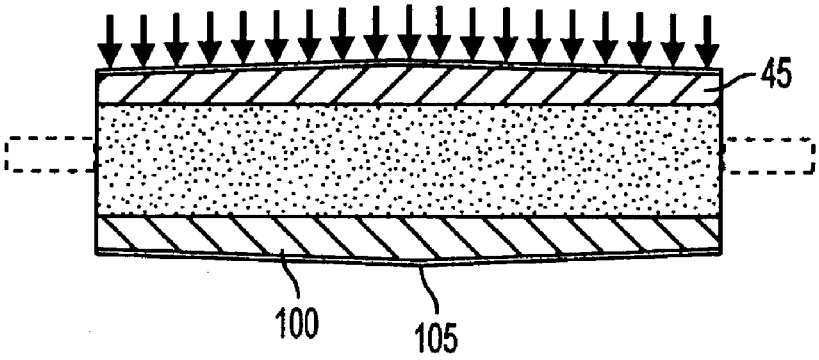
FIG. 6

APPARATUS AND METHOD FOR PRINTING WITH AN INKJET DRUM

BACKGROUND OF THE INVENTION

1. Field of the Invention

The present invention relates to a system and method for printing an image and transfer to media. More particularly, the present invention relates to an inkjet printer system having optimum image transfer and optical density by generating pressure uniformity across a transfer nip, controlling release coating thickness, and controlling a time delay between a jetting of ink and transfer of jetted ink to media.

2. Description of the Related Art

FIG. 1 illustrates an example of a conventional inkjet printer, including inkjet printer 10 having a platen or tray for receiving media, such as paper, a carriage 15 to carry ink cartridge(s) 17, and a processor 20 to control the operation of inkjet printer 10. As illustrated in FIG. 1, carriage 15 carries ink cartridge(s) 17 across media or potentially axially across intermediate transfer medium (ITM) 40, as further illustrated in FIG. 2. In FIG. 2, related to embodiments of the present invention, ink cartridges 27 travels across ITM 40 while printing onto ITM 40 in spiraled swaths, i.e., helical printing. Once the printing to ITM 40 has completed, media 30 is compressed between transfer nip 60 generated at the intersection of ITM 40 and transfer roller 45, thereby transferring the image printed on ITM 40 to media 30.

Although the example illustrated in FIG. 2 shows helical inkjet printing onto ITM 40, many alternative techniques are also available, such as printing in stepped swaths across ITM 40, for example.

FIG. 2 also illustrates that a release coating may be applied to the surface of ITM 40. The release coating is used to improve print quality, as well as release and transfer of an image from an ITM to media. The release coating is referred to as a release material because it acts as a release layer between the ITM and ink layer. In an embodiment of the present invention, illustrated in FIG. 3, ink is jetted onto the liquid coating by four print heads 37 placed around the circumference of ITM 40. As illustrated in FIG. 4, the ink can be jetted onto ITM 40 in helical direction 80 as print head(s) 47 travels axially across ITM 40, while ITM 40 rotates in direction 84. FIG. 4 also illustrates that that a portion of ITM 40 may not be printed upon to allow print head(s) 47 to properly advance to the next helical swath printing position, without overlap. FIG. 4 illustrates this portion of ITM 40 not printed upon between the leading edge 70 and trailing edge 75 of the ink image. This illustration in FIG. 4 also illustrates that ITM 40 can be a drum with an external circumference sufficient to transfer ink to the whole print area of the media in one revolution. As illustrated in FIG. 5, ITM 40 could transfer the whole printed image to media traveling through the transfer nip in one revolution.

As illustrated in FIG. 2, transfer roller 45 can be moved into contact with ITM 40 to form transfer nip 60. Transfer roller 45 may be moved into contact with ITM 40 while ITM 40 is stopped, or transfer roller 45 may be moved into contact with ITM 40 while it is rotating. Media 30 is fed into transfer nip 60, and the pressure between ITM 40 and transfer roller 45, at transfer nip 60, enables the transfer of the jetted ink from ITM 40 to media 30. If the ink transfer isn't optimized, ink will remain on ITM 40, which would require ITM 40 to be cleaned before ink can again be jetted to form the next image.

To provide an improved image quality, release coating compositions may also destabilize a colorant in ink prior to penetration into the media. The colorant in ink might be dyes, pigments, or other materials, depending on the chemical structure of the ink. Similarly, the release coating composition is designed to interact with a corresponding ink. For example, the release coating may include a flocculant, such as a liquid that contains a multivalent salt or is low pH, which may be applied to an ITM before, during, or after the jetting of ink. When the ink impacts the flocculent, the colorant in the ink destabilizes, thereby preventing penetration of the colorant into media while allowing penetration of the remaining ink constituents. Further, in this example, a mordant may also be added to the liquid composition to reduce spreading and color-to-color bleeding of the ink.

If the release coating is a low viscosity liquid, then foam rolls or felt wicks can be used to apply coatings. Very thin fluids can also be jetted via inkjet-like print heads. If fluids are of a higher viscosity (to allow the use of additives which give improved print quality or provide more rapid ink absorption effects), then more complicated application methods such as blade coating or roll coating become necessary. Both traveling coaters and page-wide coaters would be available. Apparatuses and methods for applying liquid release coatings are known, and for brevity not discussed further herein.

Examples of ITM printing systems using release coatings are described in U.S. Pat. Nos. 5,389,958, 5,805,191, and 5,677,719, all of which describe release coating material on an ITM, jetting ink onto the coated surface of the ITM, and thereafter transferring the ink image to media through a nip generated by the ITM and a roller. Liquid coating systems require fluid handling hardware, including subsystems to store fluids, to move them from the storage vessel to the coating system, to apply them to an ITM, and to clean off residue after image transfer. Examples of such liquid coating techniques have also been illustrated in U.S. Pat. Nos. 6,183,079 and 6,196,674.

In FIG. 2, the ink image on ITM 40 is transferred to media 30 by pressure at transfer nip 60. An uneven pressure profile in the transfer nip will result in non-uniform print quality across the page. The generation of a uniform pressure profile can be addressed by making the transfer roller a solid shaft, though solid shafts tend to be massive and costly to actuate. A solid shaft, which has a large mass and rotational moment of inertia, will also cause velocity fluctuations when it comes into contact with ITM 40, since the transfer roller must typically come into contact and dampen out any velocity fluctuations within the no-print zone.

In embodiments of the present invention, an ITM was initially operated with a surface speed between 26.6 to 53.3 ips, depending on the print mode. Upon operation with a drum ITM, with a circumference of 9.5 inches, surface speed of 53.3 ips, and a one inch no-print zone, with transfer roll being engaged and stabilized in 18 ms, it was determined that a massive transfer roller was needed to prevent a non-uniform pressure profile across the width of the transfer nip, which would result in degraded ink and image transfer. To reduce the problems associated with such a massive transfer roll, a hollow roll was used. The hollow roll reduced the mass in the system but also reduced the stiffness of the transfer roller. The hollow transfer roller produced larger deflection at the center of the roller, which translated into a non-uniform pressure profile.

Further examples of generating uniform pressure profiles are described in U.S. Pat. No. 5,092,235. U.S. Pat. No. 5,092,235 fails to address the additional factors of release layer thickness and ink transfer delay time the present inventors have further discovered.

As briefly noted above, a release coating is necessary when printing using an ITM. When ink is placed between two solid bodies of similar surface energy, and the two solid bodies are pulled apart, the ink is caused to split, leaving fluid on both solid bodies. With the ink system used, anything close to a 100% transfer of ink cannot be achieved unless a sacrificial layer is placed between the ink and one of the solid bodies. In this case, the sacrificial layer is the release coat. It was determined that depending on the thickness of the release material and on the rheological properties (such as cohesive strength of the release layer), different transfer efficiencies could be achieved.

Transfer is also time dependent. If the image is left on the drum for an extended amount of time, the ink begins to dry and transfer is affected. If the image is transferred too soon the pigment does not have time to flocculate, resulting in poor print quality.

Embodiments of the present invention overcome these aforementioned problems while optimizing image release and optical density.

SUMMARY OF THE INVENTION

An aspect of the present invention is to provide a method and apparatus for printing on a intermediate transfer medium with optimum image transfer and optical density.

A further aspects of the present invention is to provide the above method and apparatus for printing on a intermediate transfer medium with optimum image transfer and optical density by controlling a transfer nip pressure, release coating thickness, and image transfer delay.

Aspect and advantages of the present invention are accomplished, as noted above, by an embodiment of the present invention for an ink-jet printer including: a controller, an intermediate transfer medium, a transfer medium, and an ink-jet print head to jet ink toward the intermediate transfer medium, wherein an optimum image transfer and optical density is achieved with the transfer of ink from the intermediate transfer medium to media by generating uniform pressure across a nip generated by the intermediate transfer medium and the transfer medium and with the controller controlling release coating thickness resident on the intermediate transfer medium and controlling a time delay between a jetting of ink toward the intermediate transfer medium and transfer of jetted ink resident on a surface of the intermediate transfer medium to the media.

Further aspects and advantages of the present invention are accomplished by a further embodiment of the present invention wherein the transfer of jetted ink to the media results in nearly a 100% transfer of ink from the intermediate transfer medium to the media. The uniform pressure across the nip can be generated by the transfer medium having a crowned or tapered external surface, or alternatively, generated by the transfer medium having an internal crowned or tapered surface. The uniform pressure across the nip may also be generated by the intermediate transfer medium and the transfer medium being oriented by skewing an axis of the transfer medium relative to an axis of the intermediate transfer medium.

Additional aspects and advantages of the present invention are accomplished by a further embodiment of the present invention wherein the uniform pressure across the nip is generated by exteriorly supporting a surface of the transfer medium at positions other than along axial ends of the transfer medium. The ink-jet printer may further include a transfer medium support bracket that supports the transfer medium at the other positions using at least one support arm exteriorly supporting the transfer medium. The transfer medium support bracket may include an additional support arm, with the support arm and the additional support arm each including friction reducing contact supports for exteriorly contacting and supporting the surface of the transfer medium to generate a uniform pressure along the nip of the transfer medium and the intermediate transfer medium.

In accordance with further aspects and advantages, the release coating thickness may be controlled to have a thickness between 0.5 microns and 6 microns on the surface of the intermediate transfer medium, or the thickness of the release coating may be further controlled to have a thickness between 1 micron and 3 microns.

In accordance to additional aspects and advantages, the time delay may be between 3 and 14 seconds, the intermediate transfer medium may be a drum having an external circumference sufficient to transfer ink to the whole print area of the media in one revolution, and the transfer medium may be supported at multiple locations and can provide uniform pressure against the intermediate transfer medium regardless of the applied force.

Further aspects and advantages of the present invention are accomplished, as noted above, by an embodiment of the present invention including an intermediate transfer medium, a transfer medium, a transfer medium support bracket, and an ink-jet print head to jet ink toward the intermediate transfer medium, wherein a uniform pressure profile is generated across a nip generated by the intermediate transfer medium and the transfer medium by externally supporting, using the transfer medium support bracket, the transfer medium at positions other than along axial ends of the transfer medium. The external supporting of the transfer medium may generate the uniform pressure profile even if the transfer medium support bracket has freedom of movement.

Additional aspects and advantages of the present invention are accomplished, as noted above, by an embodiment of the present invention for a method of printing including: controlling a thickness of a release coating on an intermediate transfer medium, applying ink to the surface of the intermediate transfer medium to form an ink image, delaying a transfer of the ink image to a media, generating a uniform pressure across a transfer nip between the intermediate transfer medium and a transfer medium, and optimizing image transfer and optical density of the transfer of the ink image to the media, through the transfer nip, based on the thickness of the release coating and the delaying of the transfer of the ink image.

The transfer of the ink image to the media may result in nearly a 100% transfer of ink from the intermediate transfer medium to the media. The surface of the transfer medium may be exteriorly supporting at positions other than along axial ends of the transfer medium. The transfer medium may be further supported at the other positions using at least two support arms exteriorly supporting the transfer medium.

Aspects and advantages are accomplished with an embodiment of the present invention, wherein the release coating thickness is controlled to be between 0.5 microns to 6 microns on the surface of the intermediate transfer medium, or wherein the release coating thickness is even controlled to be between 1 micron and 3 microns. The time delay may be controlled to be between 3 and 14 seconds, and embodiments of the present invention may further comprise transferring the ink image to the media within one revolution of the intermediate transfer medium.

BRIEF DESCRIPTION OF THE DRAWINGS

These and other aspects and advantages of the invention will become apparent and more readily appreciated for the following description of the preferred embodiments, taken in conjunction with the accompanying drawings of which:

FIGS. 5A–5D are illustrations of a process of applying coating, applying ink, and then transferring the applied ink to media;

FIG. 6 is an illustration of an embodiment of the present invention using a transfer roller having a crowned exterior surface;

DESCRIPTION OF THE PREFERRED EMBODIMENTS

Figure 1:
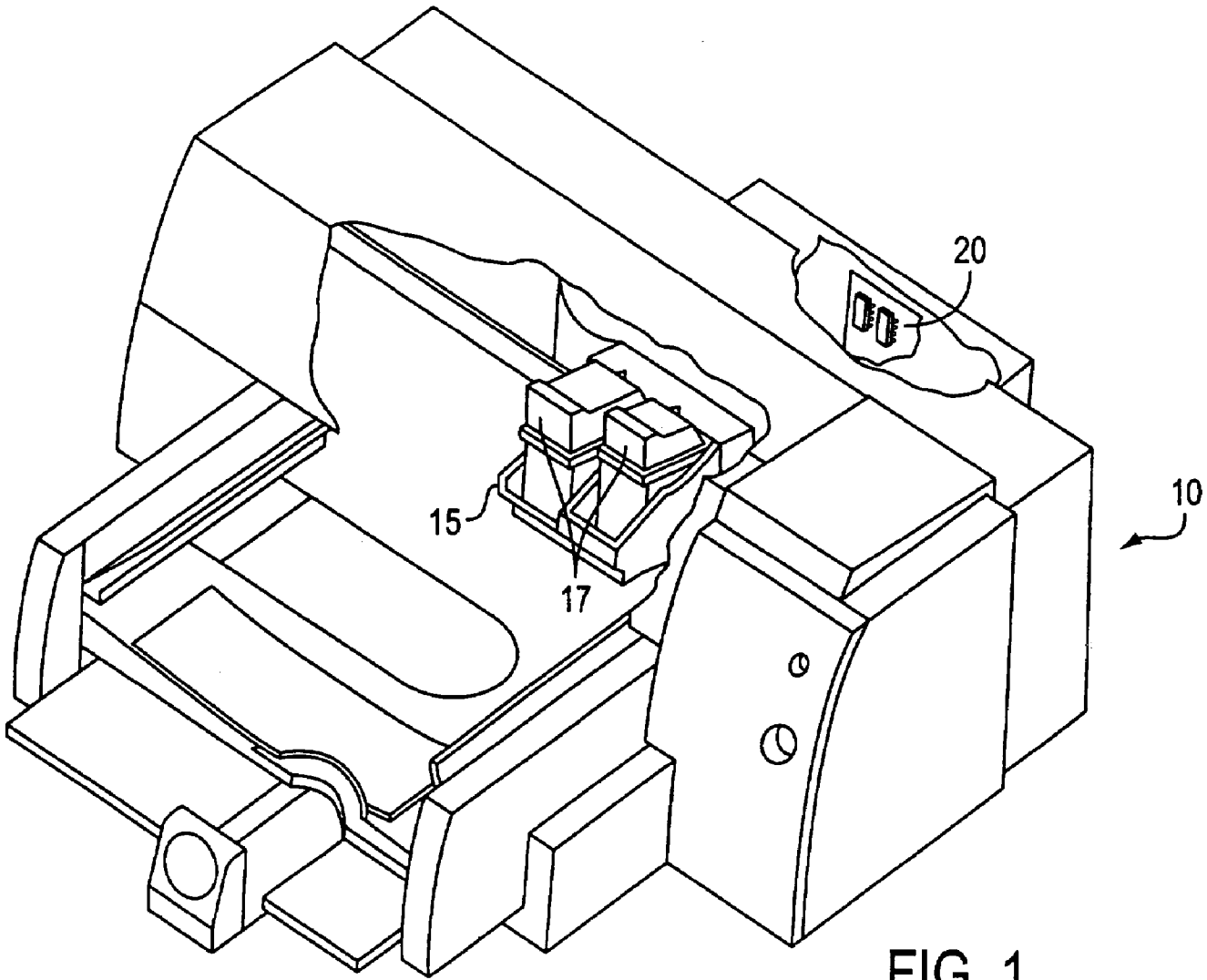
FIG. 1 (PRIOR ART)
FIG. 1 is an illustration of a conventional inkjet printer.
Figure 2:
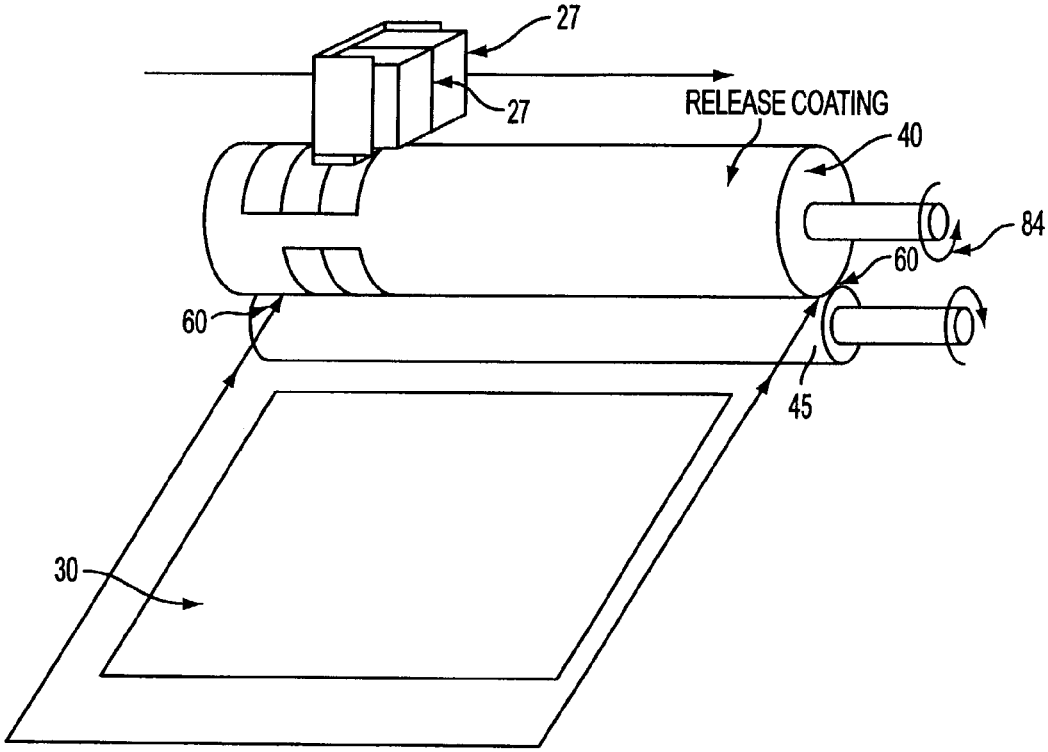
FIG. 2 is an illustration of helical printing using an intermediate transfer drum.
Figure 3:
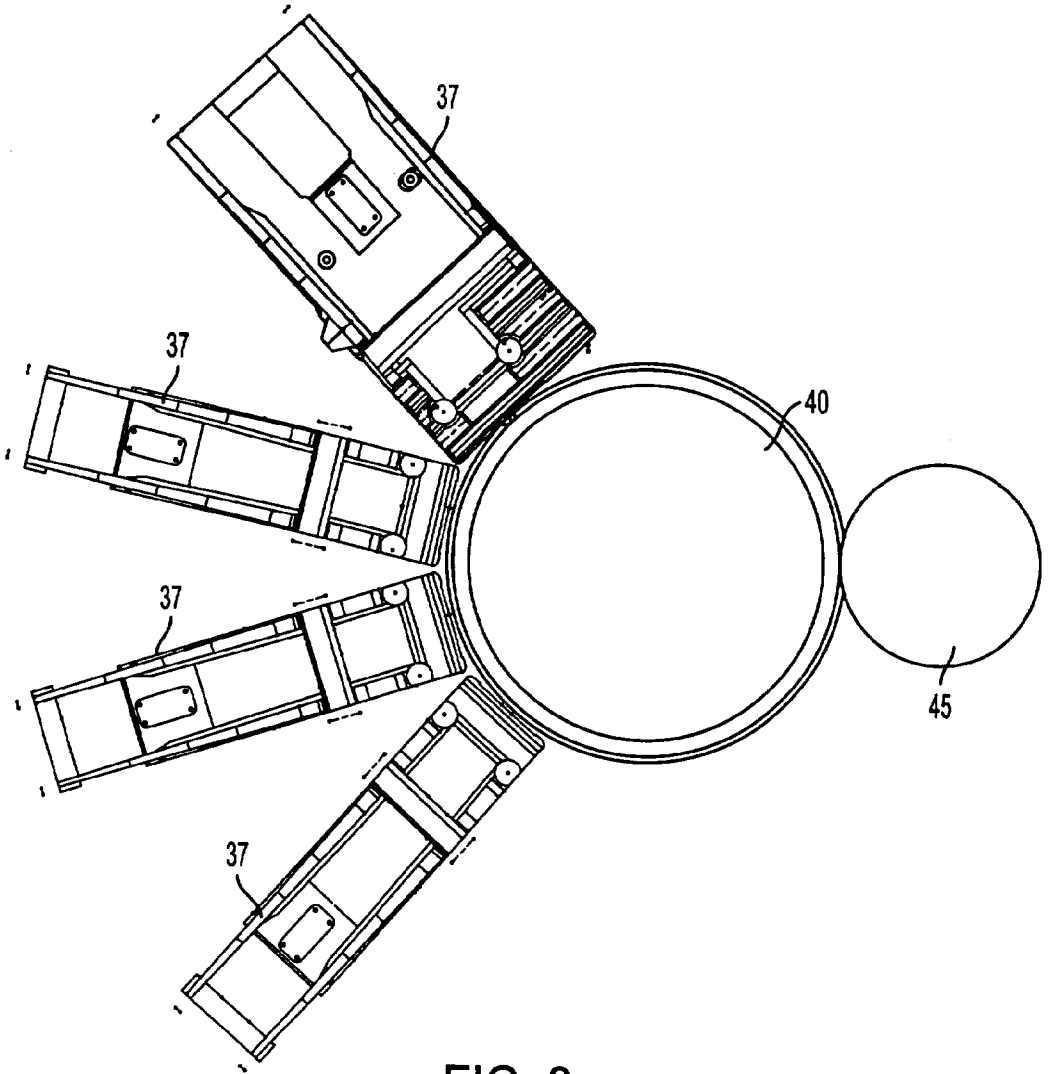
FIG. 3 is an illustration of an intermediate transfer drum, a transfer roller, and an arrangement of print heads around the intermediate transfer drum.
Figure 4:
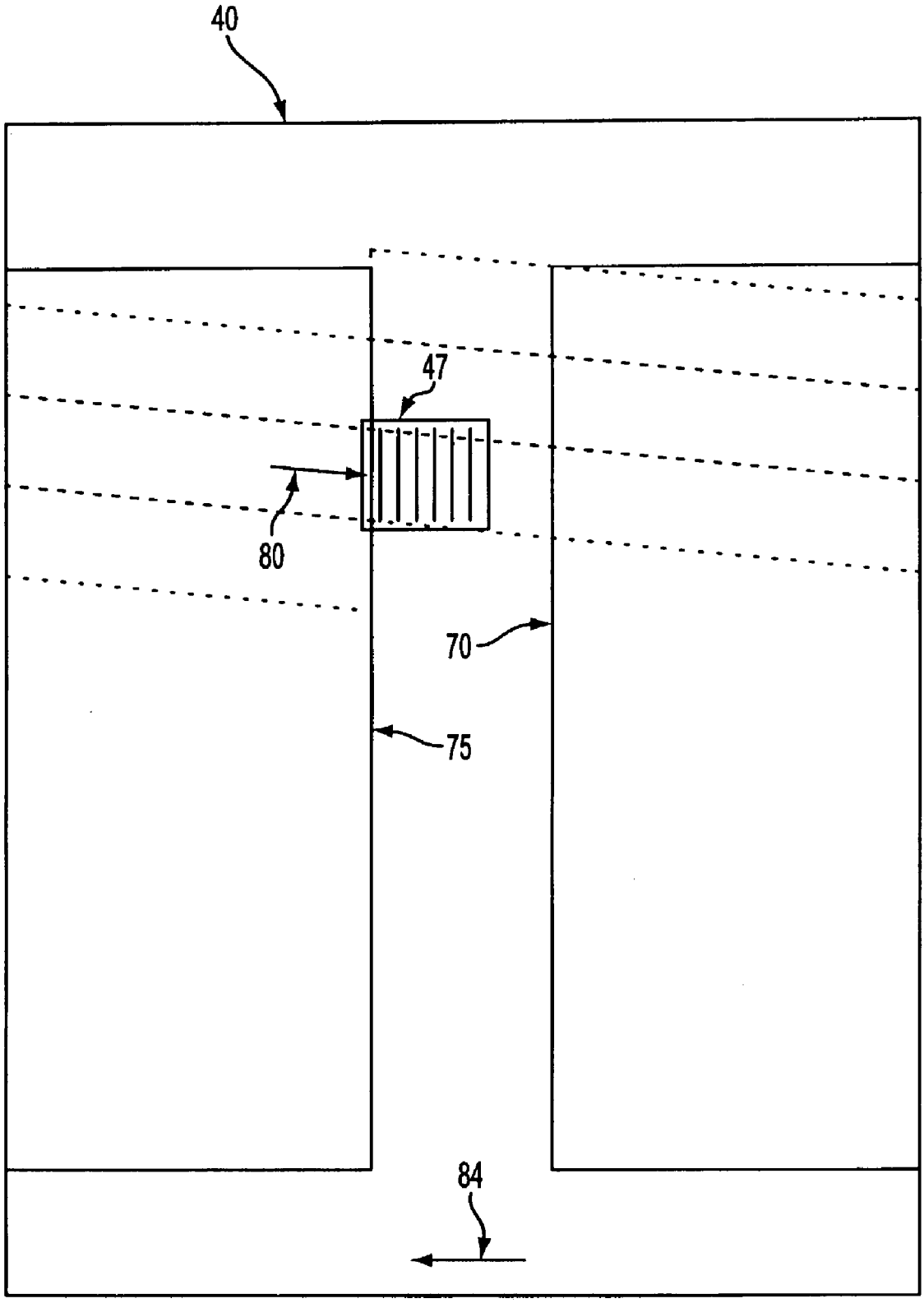
FIG. 4 is an illustration of a helical path of a print head depositing ink on an intermediate transfer medium.

Reference will now be made in detail to the preferred embodiments of the present invention, examples of which are illustrated in the accompanying drawings, wherein like reference numerals refer to like elements throughout.

In accordance with the present invention, preferred embodiments of the present invention are directed toward providing an ink-jet printing method and apparatus with optimum image transfer and optical density.

As noted above, the present inventors have found that optimum image transfer and image density are dependent on at least three factors: pressure across a transfer nip, thickness of a release coating, and delay time from jetting of ink onto an ITM until the transfer of the ink to media. As also noted above, conventionally, nearly 100% transfer of ink was not typically achievable, due to some imbalance of one or more of the above factors.

Embodiments of the present invention are primarily directed to the use of an intermediate transfer medium. An intermediate transfer medium (ITM) can be a medium, e.g., a drum or belt, onto which a release coating and ink is applied, with media (e.g., paper) thereafter being made to come into contact with to the ITM to transfer, respectively, the ink alone or the release coating and ink to the media.

FIGS. 5A–5D illustrate an example of an ITM printing process. A release coating is first applied to the surface of ITM 40 using applicator 35, thereby generating coating layer 50 (FIG. 5B). Thereafter, the applicator of the release coating is withdrawn and ink jet cartridge 57 operates to deposit ink image 55 onto ITM 40 (FIG. 5C). After ink jet cartridge 57 suspends the ink jetting operation, media 30 is caused to transit through the transfer nip generated between ITM 40 and transfer roller 45 (FIG. 5D).

FIGS. 6 and 8–10 illustrate four different uniform pressure generating transfer rollers. FIG. 6 illustrates a transfer roller 45 being hollowed and having a crowned or tapered outer surface. The tapering or crowning is illustrated in FIG. 6, where the exterior surface 100 of transfer roller 45 crowns at mid-point 105 of transfer roller 45. As illustrated in FIG. 6, an even transfer load can be generated, generally with the load range being a range of loads applied to transfer roller 45 falling between 8 and 25 lb. By coring out a solid shaft of transfer roller 45, the mass of the roller is reduced and transfer roller 45 can be moved more quickly with less force. Crown 105, thereby, enables transfer roller 45 to compensate for any unwanted deflections across the transfer nip.

Figure 7:
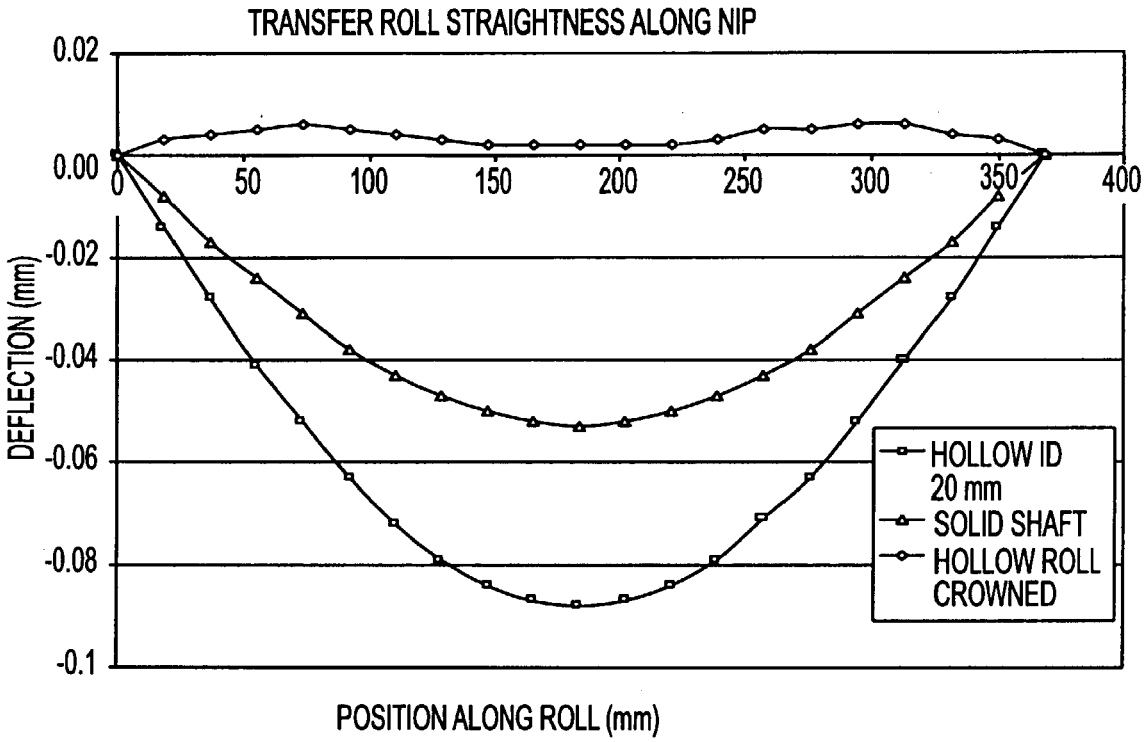
FIG. 7 is a graph of the transfer nip pressure using a hollow transfer roller, a solid shaft transfer roller, and a crowned hollow transfer roller.

FIG. 7 is a graphical illustration of benefits of the hollow crowned transfer roller over a solid shaft transfer roller and a straight hollowed transfer roller without any crowning or tapering. In this case, the crowned hollow transfer roller has a 0.10 mm crown to compensate for unwanted deflection. It is desirable to match the size of the crown with the expected amount of deflection. If the two are equal, a uniform pressure profile can be produced at the transfer nip. By making the shaft of the transfer roller hollow, the weight of the shaft can be significantly reduced, reducing inertia and shortening rotations required to cease rotation of the transfer roller. In this embodiment, the bending stiffness of the shaft of the transfer roller is not significantly affected by the crowning. In addition, the crowned transfer roller shaft is typically only designed for one load.

Figure 8:
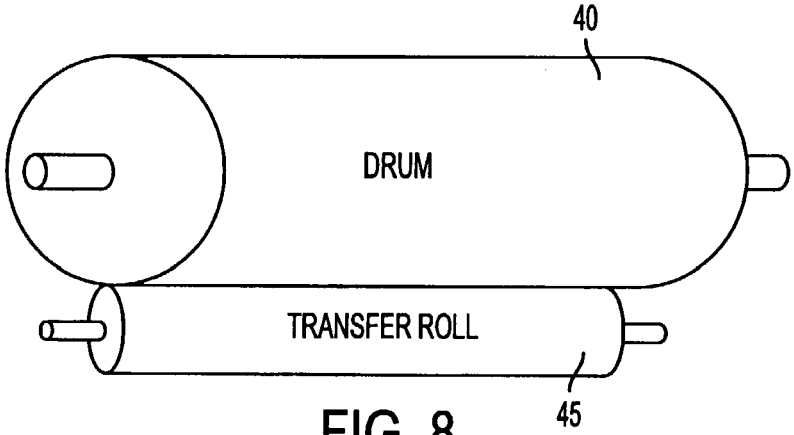
FIG. 8 is an illustration of a transfer roller being skewed to the axis of an ITM in another embodiment of the present invention.

FIG. 8 illustrates another embodiment for achieving a uniform pressure profile. In FIG. 8, the axis of transfer roller 45 is skewed relative to ITM 40. The axis skew aligns the point of largest deflection on transfer roller 45 with a center point on the surface of ITM 40. As transfer roller 45 deflects, transfer roller 45 begins to wrap around ITM 40. Initially, transfer roller 45 has only a point contact with ITM 40. As transfer roller 45 starts to deflect, additional surface area of transfer roller 45 comes into contact with ITM 40. If the skew angle is chosen correctly the forces between transfer roller 45 and ITM 40 will be evenly distributed along the length of the transfer nip. Essentially, the idea is to misalign transfer roller 45 and ITM 40 so the deflection of transfer roller 45 equals the resultant bending. In this embodiment, media tends to skew when moving through the transfer nip, so the amount of skew should not be excessive. Similar to the crowned shaft illustrated in FIG. 6, the axis skew illustrated in FIG. 8 is typically designed for only one load.

Figure 9:
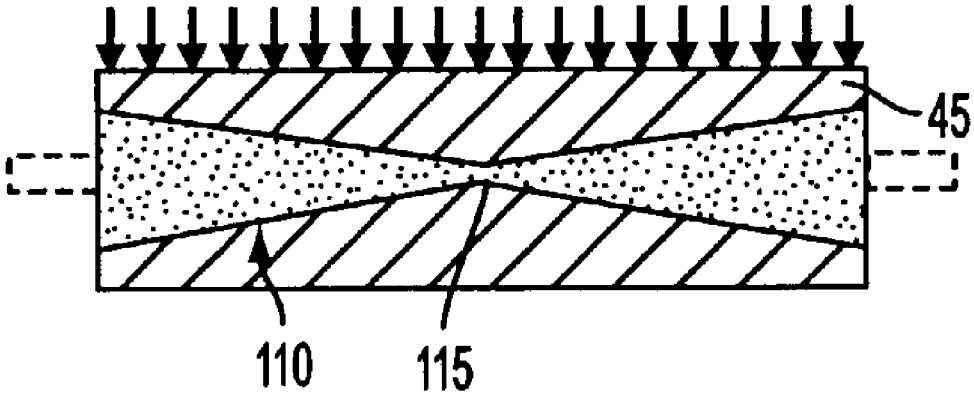
FIG. 9 is an illustration of a transfer roller having a tapered or crowned internal surface according to another embodiment of the present invention.

Another embodiment of the present invention achieves uniform pressure across the transfer nip by increasing the stiffness of transfer roller 45, as illustrated in FIG. 9. The increasing of the stiffness can be achieved by thickening the uniform walls of a hollowed transfer roller 45, though this may result in an increase in mass of the transfer roller 45 shaft, and might still result in a non-uniform (though improved) pressure distribution.

Alternatively, an inside radius of transfer roller 45 may be gradually tapered or the interior surface 110 may essentially be crowned 115 to increase stiffness centrally. By decreasing the inner diameter as one moves toward the center of transfer roller 45, the stiffness will be increased and a maximum stiffness will be provided at the point of maximum potential deflection. The inner diametrical taper may be a linear function of transfer roller 45 shaft length, or (more appropriately) a polynomial fit to best match the shaft stiffness with the desired shaft bending/nip pressure characteristics. The method chosen should be judged against manufacturing concerns in a final design selection.

The idea is to increase the stiffness and decrease the deflection of transfer roller 45, while minimizing the weight. The thickness tapering (shaft stiffening) illustrated in FIG. 9 may be combined with the crowning illustrated in FIG. 6 to provide further flexibility in generating a uniform transfer nip pressure.

Figure 10:
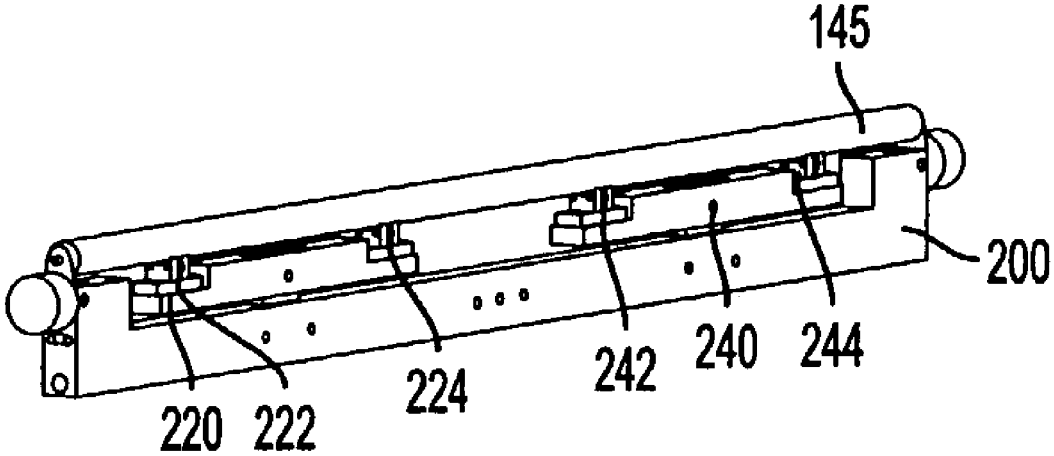
FIG. 10 is an illustration of a transfer roller supported by a support bracket and two support arms also mounted on the support bracket in yet another embodiment of the present invention.
Figure 11A:
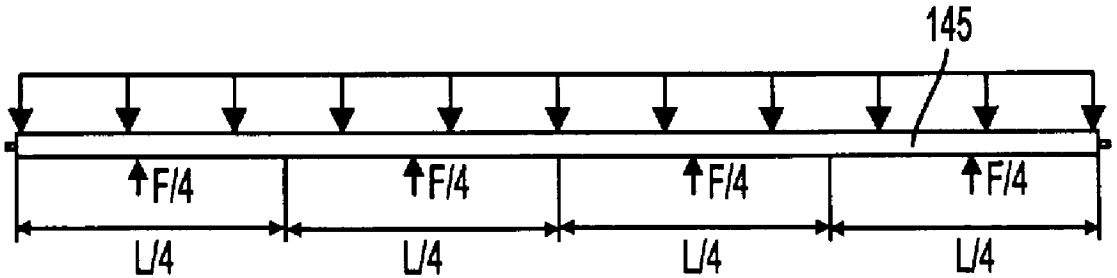
FIG. 11A is a graphical illustration of the load forces on a transfer roller when supported by the support bracket illustrated in FIGS. 10 and 11B.
Figure 11B:
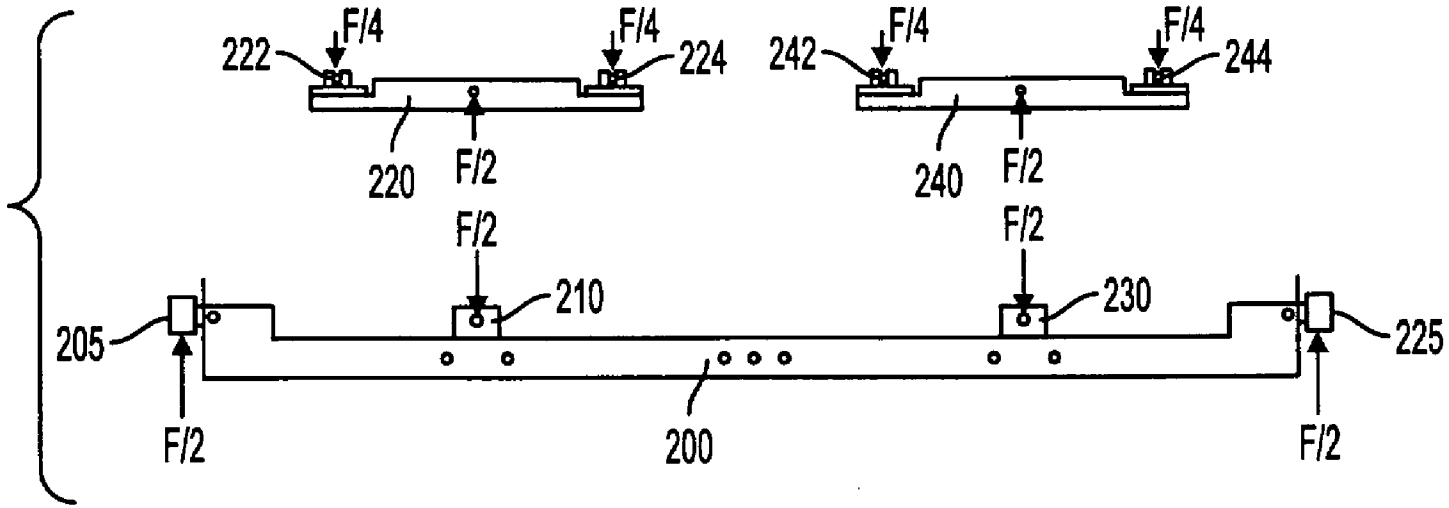
FIG. 11B is a graphical illustration of the load forces on the support bracket illustrated in FIG. 10.

Another embodiment for achieving uniform transfer nip pressure while minimizing weight is shown in FIGS. 10 and 11A–11B. Instead of supporting transfer roller 145 along the axial ends, or only along the axial ends, transfer roller 145 can also be supported with V-block bearings or rollers at multiple locations along the shaft of transfer roller 145. Based on this embodiment, transfer roller 145 can be significantly smaller in diameter than those illustrated in the previous embodiments. A potential drawback to this supporting embodiment is that transfer roller support bracket 200 holds V-block bearings 222, 224, 242 and 244, and has mass of its own that must be moved along with transfer roller 145. A savings in weight by using this smaller transfer roller diameter embodiment is partially offset by the requirement that transfer roller support bracket 200 also be required. In addition to the four supporting positions using V-block bearings 222, 224, 242 and 244, additional support positions could be used, as well as alternative low friction surface materials other than V-block bearings.

As illustrated in FIGS. 11A and 11B, an important feature of the transfer roller support bracket 200 embodiment is the way in which transfer roller support bracket 200 and support arms 220 and 240 distribute support forces to transfer roller 145. FIGS. 11A and 11B illustrate a free body force diagram of transfer roller 145, support arms 220 and 240, V-block bearings 222, 224, 242, and 244, and pivots 210 and 230. Transfer roller support bracket 200 should be designed to be supported by both of its ends 205 and 225. In addition, the supporting of transfer roller support bracket 200 along ends 205 and 225 could be performed using a pin joint allowing for misalignment. The lifting force at each end 205 and 225 will be F/2. Lifting forces on support arms 220 and 240 is F/2 and the resulting lifting force at each V-block bearing 222, 224, 242 and 244 is F/4. Since the lifting force on transfer roller 145 is centered in each L/4 segment, the support force will be equally distributed regardless of the force applied. This is true even if there is bending in transfer roller support bracket 200. In addition, since some bending and movement of transfer roller support bracket 200 and support arms 220 and 240 would not alter the equal pressure profile on transfer roller 145, alternative lower cost and lighter materials could be implemented, thereby negating the need of a rigid still support member. Thus, according to this embodiment, a small diameter shaft of transfer roller 145 can be supported at multiple locations and provide uniform pressure against ITM 40 regardless of the applied force.

As noted above, embodiments of the present invention included operating ITM 40 at surface speed between 26.6 and 53.3 ips, depending on the print mode. In addition, upon operation in a drum ITM embodiment, with an experimental drum circumference of 9.5 inches, a surface speed of 53.3 ips, and a one inch no-print zone. Transfer roller was also engaged and stabilized in 18 ms.

Figure 12:
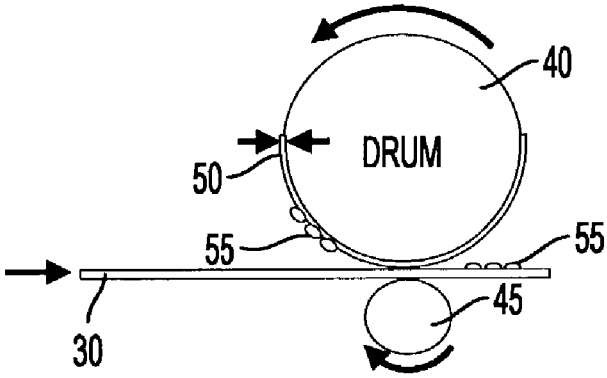
FIG. 12 is an illustration of a release coating thickness in a drum ITM system.

As noted above, an additional factor to achieve optimum image transfer and optical density is release layer thickness. FIG. 12 illustrates ITM 40 rotating as media 30 traverses through the transfer nip. As illustrated in FIG. 12, preferably, release layer 50 facilitates the transfer of ink image layer 55 to media. Through experimentation, a range of release film thickness tested was between 0.25 and 15.0 microns.

An optimum release coating thickness was observed between 0.5 microns and 6 microns. In this range of release coat thickness, nearly 100% of the ink was transferred from ITM 40 to media 30, resulting in low or no ink residual on ITM 40. The high ink transfer efficiency also resulted in high optical densities, high chroma of the image on the page, and a good quality of the printed image. Preferred ranges of ink transfer would be between 60 and 100%, though nearly 100%, e.g., around 90% and greater, is more preferred. The use of an optimized range also translated into minimizing ink use because of high use efficiencies. The print quality of the image on the media obtained after transfer from ITM 40, coated with the release coat in the optimum thickness range, was characterized by low mottling and smooth surfaces.

When the release coat thickness fell below 0.5 micons, the transfer efficiency was lowered. Some ink was left as a residual on ITM 40. The printed image on the page was non-uniform, mottled and had lower optical densities and chromas. This was the result of both having some ink passing through the too thin release coating layer and contacting ITM 40, and also not having enough release coating available for the film split that occurs during ink image transfer. In addition, very thin release coating layers ended up drying on ITM 40 before an ink image was transferred to the media.

At a release coat thickness greater than 6 microns, a significant amount of fluid became present in the transfer nip during the transfer process, and resulted in poor print quality of the printed image on the media, as a non-uniform, mottled and somewhat distorted image. In addition, with the greater release coating thickness, the detachment of media from ITM 40 became difficult and release coating residual was left both on the drum and sometimes at the axial ends of the transfer roller.

For lower viscosity fluids and thicker release coating layers, pigment migration was also observed before transfer, which resulted in distorted images on media. It was found that by increasing a polymer or gellant content in the release coat this phenomenon was reduced. In addition, in one embodiment, in order to minimize the amount of release coat used for transfer, an optimum coat thickness desired was found to be between 1 and 3 microns.

In addition to the release coating layer thickness and uniform transfer nip pressure, a time delay between printing of the ink on the release coating layer and transfer of the image to media showed itself to be another critical process variable.

Transfer of ink from an ITM to media is influenced by a time delay between the printing onto the ITM and the transfer of the printed image from the ITM to media. Transfer of the image from the ITM to media was possible for all delay times between 0 and 20 seconds for the various ink/release material formulations tested. An optimum time delay between printing ink onto the ITM and transfer of ink to media was found to be between 3 and 14 seconds. For this time delay range nearly 100% transfer efficiencies were observed and high optical densities and high chroma of the print were measured on the media. The printed image on the media was uniform and smooth.

For shorter time delays between ink printing on the ITM and transfer to the media (below 3 seconds), the image on the media was mottled and lower optical densities and chromas were recorded. At this short delay times the image on the page was distorted and residual ink was left on the ITM.

The ink stabilization and flocculation on the release coat was found to be incomplete in these cases and, at transfer, the uppermost layer of the ink still liquid was absorbed into the surface of the paper.

At time delays greater then 14 seconds (between ink printing on the ITM and transfer to the media) transfer efficiencies were reduced and the quality of the transferred image was low. High ink residual was observed on the ITM and incomplete transfer of the ink to media was observed. The printed image on media was mottled and non-uniform, and lower optical densities and chromas were recorded.

Figure 13:
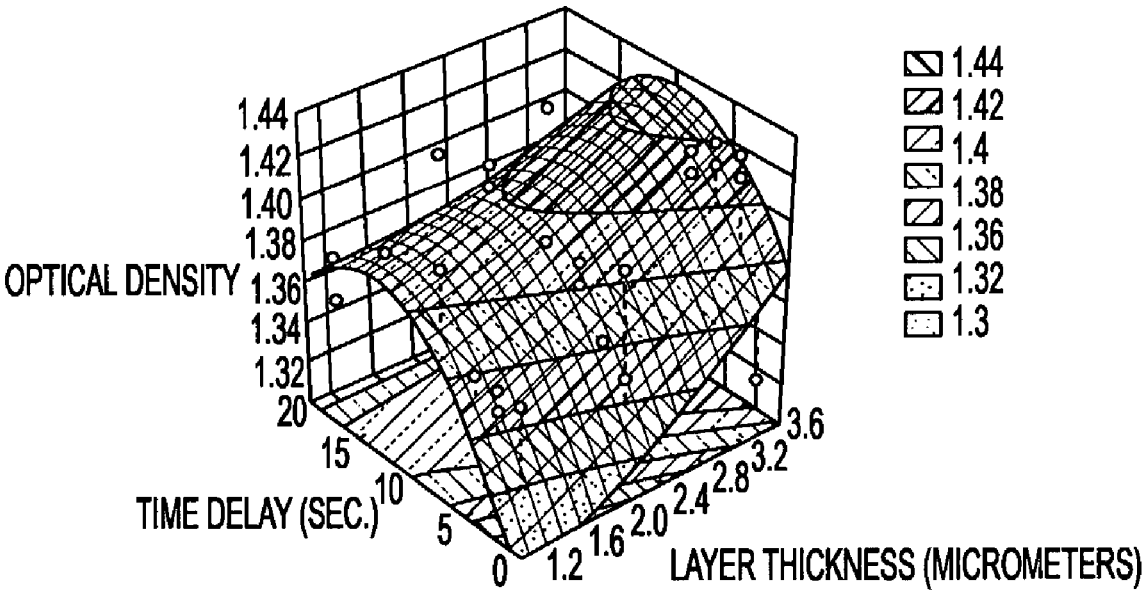
FIG. 13 is a graph illustrating the optical density of ink on a media versus the time delay after the jetting of ink to the intermediate transfer medium and the release layer thickness.

FIG. 13 sets forth a graph of the optical density of ink on media versus time delay after print and release layer thickness. Based on these experimental determinations the aforementioned optimum release coats thickness and delay times have been derived.

An optimum time delay varies slightly depending on the ink formulation, release coat formulation and film thickness. The ink formulation affects the flocculation rate of the pigment depending on the pigment to dispersant ratio and dispersant type. Higher pigment to dispersant ratios resulted in shorter optimum delay times between print and transfer. The release coat formulation also affects the flocculation rate depending on the flocculant amount and type. In addition, higher amounts of flocculant will shift the optimum delay after print time range towards shorter times. For release coat formulations that showed pigment migration, the effect was increased for long delay times between print and transfer.

As noted above, FIG. 1 illustrates a conventional ink-jet printer having a processor to control operations of the printer. Some of the aforementioned embodiments may include use of such a processor in the ink-jet printer, a processor connected to the ink-jet printer, or in the alternative, mechanical systems resident in the printer, to control the speed of the ITM, the movement of the transfer roller, application of the release coating, and control of the thickness of the same, printing of ink to the ITM surface, delay of transfer from the ITM surface to media, and ultimate transportation of media through the transfer nip between the ITM and the transfer roller.

Thus, although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An ink-jet printer, comprising:

a controller;

an intermediate transfer medium;

a transfer roller; and an ink-jet print head to jet ink toward the intermediate transfer medium, wherein an optimum image transfer and optical density is achieved with the transfer of ink from the intermediate transfer media to medium by generating uniform pressure across the nip generated by the intermediate transfer medium and the transfer roller wherein the uniform pressure across the nip is generated by exteriorly supporting a surface of the transfer roller other than along axial ends of the transfer roller utilizing a transfer roller support arm and with the controller controlling release coating thickness resident on the intermediate transfer medium and controlling the time delay between a jetting of ink towards the intermediate transfer medium and transfer of jetted ink resident on a surface of the intermediate transfer medium to the media.

2. The ink-jet printer of claim 1, wherein the transfer of jetted ink to the media provides a nearly 100% transfer of ink from the intermediate transfer medium to the media.

3. The ink-jet printer of claim 1, wherein the uniform pressure across the nip is generated that the transfer medium having a crowned or tapered external surface.

4. The ink-jet printer of claim 1, wherein the uniform pressure across the nip is generated by the transfer medium having an internal crowned or tapered surface.

5. The ink-jet printer of claim 1, wherein the uniform pressure across the nip is generated by the intermediate transfer medium and the transfer medium being oriented by skewing an axis of the transfer medium relative to an axis of the intermediate transfer medium.

6. The ink-jet printer of claim 1, further comprising a transfer roller support bracket that supports said transfer roller support arm.

7. The ink-jet printer of claim 6, wherein the transfer roller support bracket includes an additional support arm, with the support arm and the additional support arm each including friction reducing contact supports for exteriorly contacting and supporting the surface of the transfer roller to generate a uniform pressure along the nip of the transfer roller and the intermediate transfer medium.

8. The ink-jet printer of claim 7, where the thickness of the release coating was controlled to have a thickness between 1 micron and 3 microns.

9. The ink-jet printer of claim 1, wherein the release coating thickness is controlled to have a thickness between 0.5 microns and 6 microns on the surface of the intermediate transfer medium.

10. The ink-jet printer of claim 1, wherein the time delay is controlled to be between 3 and 14 seconds.

11. The ink-jet printer of claim 1, wherein the intermediate transfer medium is a drum having an external circumference sufficient to transfer ink to the whole print area of the media in one revolution.

12. The ink-jet printer of claim 1, wherein the transfer roller is supported at multiple locations and can provide uniform pressure against the intermediate transfer medium regardless of the applied force.

13. A method of printing, comprising: controlling a thickness of a release coating on an intermediate transfer medium; applying ink to the surface of the intermediate transfer medium to form an ink image; by an ink jet print head delaying a transfer of the ink image to a media; generating a uniform pressure across a transfer nip between the intermediate transfer medium and a transfer roller by exteriorly supporting a surface of the transfer roller at positions other than along axial ends of the transfer roller utilizing a transfer roller support arm and optimizing image transfer and optical density of the transfer of the ink image to the media, through the transfer nip, based on the thickness of the release coating and the delaying of the transfer of the ink image.

14. The method of claim 13, wherein the transfer of the ink image to the media provides nearly a 100% transfer of ink from the intermediate transfer medium to the media.

15. The method of claim 13, wherein the release coating thickness is controlled to be between 0.5 microns and 6 microns on the surface of the intermediate transfer medium.

16. The method of claim 15, wherein the release coating thickness is controlled to be between 1 micron and 3 microns.

17. The method of claim 13, wherein the time delay is controlled to be between 3 and 14 seconds.

18. The method of claim 13, further comprising transferring the ink image to the media within one revolution of the intermediate transfer medium.

19. The method of claim 13, further comprising supporting said transfer roller support arm with a transfer roller support bracket.

* * * * *